US007392758B2

(12) United States Patent
Metcalf

(10) Patent No.: US 7,392,758 B2
(45) Date of Patent: Jul. 1, 2008

(54) WAKE TOWER AND METHOD OF MAKING SAME

(76) Inventor: Robert Metcalf, 12960 Bradley Ave., Sylmar, CA (US) 91342

( * ) Notice: Subject to any disclaimer, the term of this patent is extended or adjusted under 35 U.S.C. 154(b) by 0 days.

(21) Appl. No.: 11/707,704

(22) Filed: Feb. 14, 2007

(65) Prior Publication Data

US 2007/0137554 A1 Jun. 21, 2007

Related U.S. Application Data

(63) Continuation-in-part of application No. 11/331,601, filed on Jan. 12, 2006, now Pat. No. 7,219,617, which is a continuation-in-part of application No. 10/751,218, filed on Dec. 31, 2003, now Pat. No. 6,986,321, and a continuation-in-part of application No. 10/401,644, filed on Mar. 27, 2003, now Pat. No. 6,792,888.

(51) Int. Cl.
*B63B 17/00* (2006.01)

(52) U.S. Cl. ..... 114/361; 114/253; 114/364

(58) Field of Classification Search ..... 114/253, 114/343, 361, 364; 296/84.1
See application file for complete search history.

(56) References Cited

U.S. PATENT DOCUMENTS

| | | | | | |
|---|---|---|---|---|---|
| 4,955,313 | A * | 9/1990 | Terry, III | ..... | 114/361 |
| 5,052,326 | A * | 10/1991 | Wiggen et al. | ..... | 114/343 |
| 5,979,350 | A * | 11/1999 | Larson et al. | ..... | 114/253 |
| 6,044,788 | A * | 4/2000 | Larson et al. | ..... | 114/253 |
| 6,192,819 | B1 * | 2/2001 | Larson et al. | ..... | 114/253 |
| 6,374,762 | B1 * | 4/2002 | Larson et al. | ..... | 114/253 |
| 6,792,888 | B1 * | 9/2004 | Metcalf | ..... | 114/364 |
| 6,986,321 | B2 * | 1/2006 | Metcalf | ..... | 114/364 |
| 7,219,617 | B2 * | 5/2007 | Metcalf | ..... | 114/364 |
| 2006/0087146 | A1 * | 4/2006 | Erskine et al. | ..... | 296/84.1 |

* cited by examiner

*Primary Examiner*—Lars A Olson

(57) ABSTRACT

An attractive wake tower assembly that can be readily pivotally mounted on powerboats of various constructions to enable the wake tower assembly to be pivoted from an upstanding to a lowered position. The wake tower assembly is of a high-strength, simple construction that does not interfere with the visibility of the boat operator. In one form of wake tower assembly, the windshield component and the wake tower component are of a novel unitary construction.

19 Claims, 15 Drawing Sheets

46
48
62a
69
62
38
34
69
66
60
76

64a
72
73
38
34
48
73
64
60
72

46
51
48
8
9
7
64a
72
64
60
62
62a
66
38
76
76
9
38
34
7
8

142
116
150
122a
122
117
118
126
34
122b
128
112
118a
124

142
116
118
150
152
117
118
34
122b
145
112
152

142
116
146
122a
122
118a
118
124
126
34
122b
128
145
112
156
154
117

142
122a
22
122
118
34
132
124
145
146
145a
150
116
156
23
122b
112

WAKE TOWER AND METHOD OF MAKING SAME

BACKGROUND OF THE INVENTION

This is a Continuation In Part of Application U.S. Ser. No. 11/331,601 filed Jan. 12, 2006 now U.S. Pat. No. 7,219,617, which is a Continuation In Part of application Ser. No. 10/751,218 filed Dec. 31, 2003, now U.S. Pat. No. 6,986,321, which is a Continuation In Part of application Ser. No. 10/401,644 filed Mar. 27, 2003, now U.S. Pat. No. 6,792,888.

FIELD OF THE INVENTION

The present invention relates generally to water sports to such as wakeboarding. More particularly, the invention concerns a wake tower of novel construction for use with powerboats for towing a performer behind the boat using a tow rope that is connected to the wake tower.

DISCUSSION OF THE PRIOR ART

In recent years the sport of wakeboarding has become very popular. As the name implies, the wake boarder intentionally rides the wake of the boat and prefers to have as large wake as possible generated behind the boat. Experience has shown that to take full advantage of the wake generated by the boat, it is preferable to anchor the towline used to tow the wake boarder at a relatively high elevation above the deck of the boat. Accordingly, a large number of elevated wake towers of various constructions have been suggested in the past.

Typically, the prior art wake towers comprise a rather large and somewhat elaborate framework that is affixed to the boat deck. Such prior art wake towers are heavy and generally quite cumbersome to install and remove from the boat. Further, such towers may interfere with the boat's passage beneath bridges and other types of overpasses. Additionally, because of the complexity of the framework of several of the prior art wake towers, visibility of the operator of the boat can be impaired. Exemplary of prior art wake towers are those illustrated and described in U.S. Pat. No. 5,979,350 issued to Larson, et al., and U.S. Pat. No. 6,193,819 issued to Larson, et al.

To accommodate the overhead clearance problem, certain of the prior art wake tower structures can be dismantled if necessary. However, such prior art structures often have questionable structural stability when erected and can present substantial safety hazards after being disassembled. For example, after the wake tower structures have been disassembled they can present a substantial tripping hazard to passengers on the boat especially when the boat is being rocked by waves. Further, in their dismantled configuration, the wake tower structures typically undesirably reduce the usable space on the boat deck.

Another approach to accommodating overhead clearance problems has been to construct a wake tower assembly that is pivotally interconnected with the boat so that the wake tower can be moved from an elevated position to a lowered position. Exemplary of this prior art approach, it is a wake tower assembly sold by the Titan Company of Rancho Cordova, Calif.

SUMMARY OF THE INVENTION

By way of summary, one form of the wake tower assembly of the present invention comprises a first base member that can be connected to the gunwale on one side of a power boat;

a second base member that can be connected to the gunwale on the opposite side to of a power boat; a generally U-shaped, structural member having a first curved side connected to the first base member and a second curved side connected to the second base member, each of the sides having an upper portion and a lower portion each of which is generally oval in cross section, the lower portion of each of the sides having a first width and the upper portion of each of the sides having a second width less than the first width; and a bight portion interconnecting the upper portions of the sides, the bight portion being generally circular in cross section. In one form of the invention, the U-shaped structural member can be pivoted downwardly toward the bow of the powerboat and in another form of the invention the U-shaped structural member can be pivoted downwardly toward the stern of the boat.

With the foregoing summary in mind, it is an object of the present invention to provide a highly attractive wake tower assembly of a unique, generally U-shaped configuration that can be readily mounted on powerboats of various constructions.

Another object of the present invention to provide a highly attractive unitary wake tower assembly of the aforementioned character that comprises a windshield component and a tower component that are formed as a single, integral unit.

DESCRIPTION OF THE INVENTION

Figure 1:
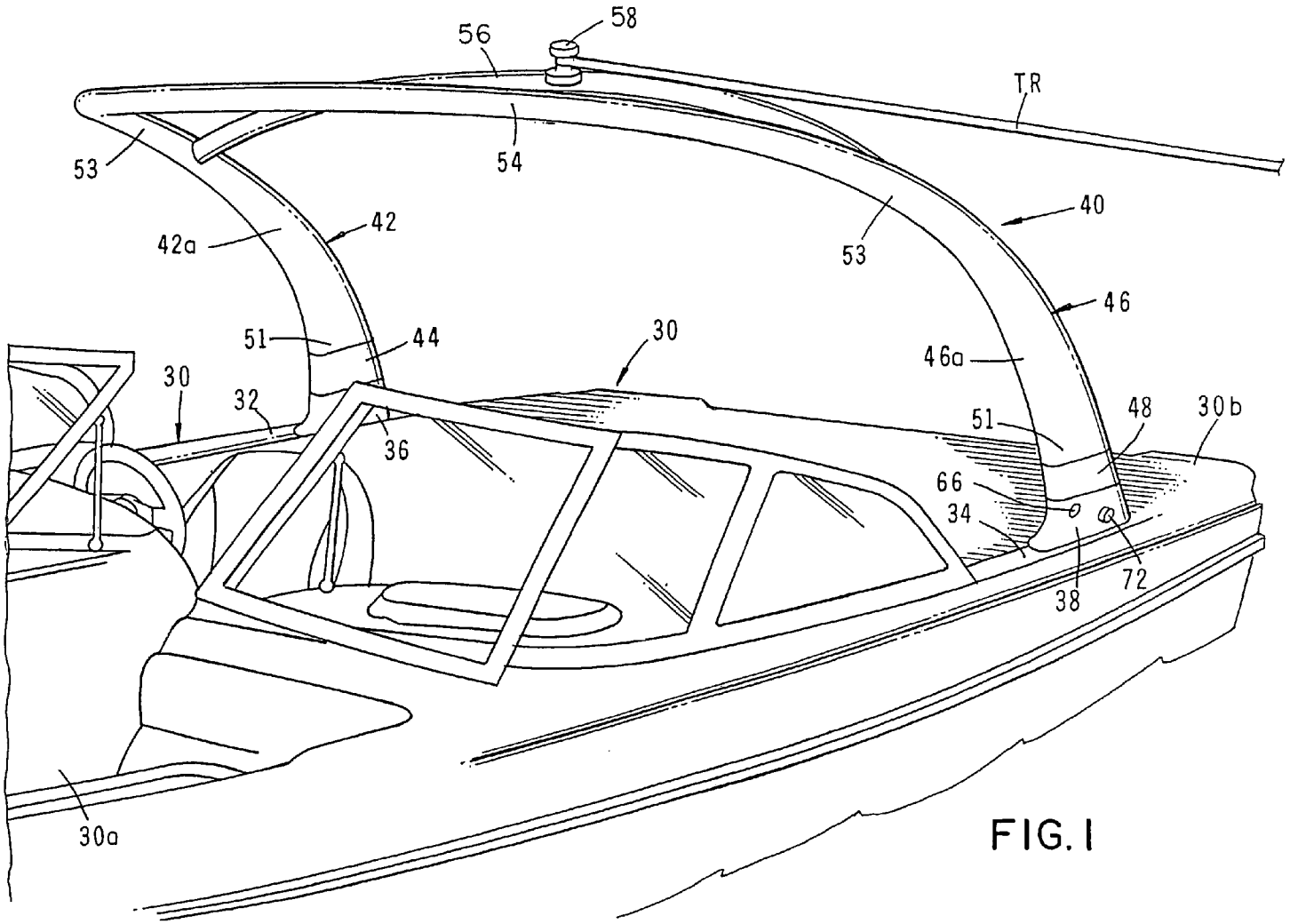
FIG. 1 is a generally perspective view of one form of the wake tower of the present invention shown affixed to the gunwales of a powerboat.
Figures 2, 4:
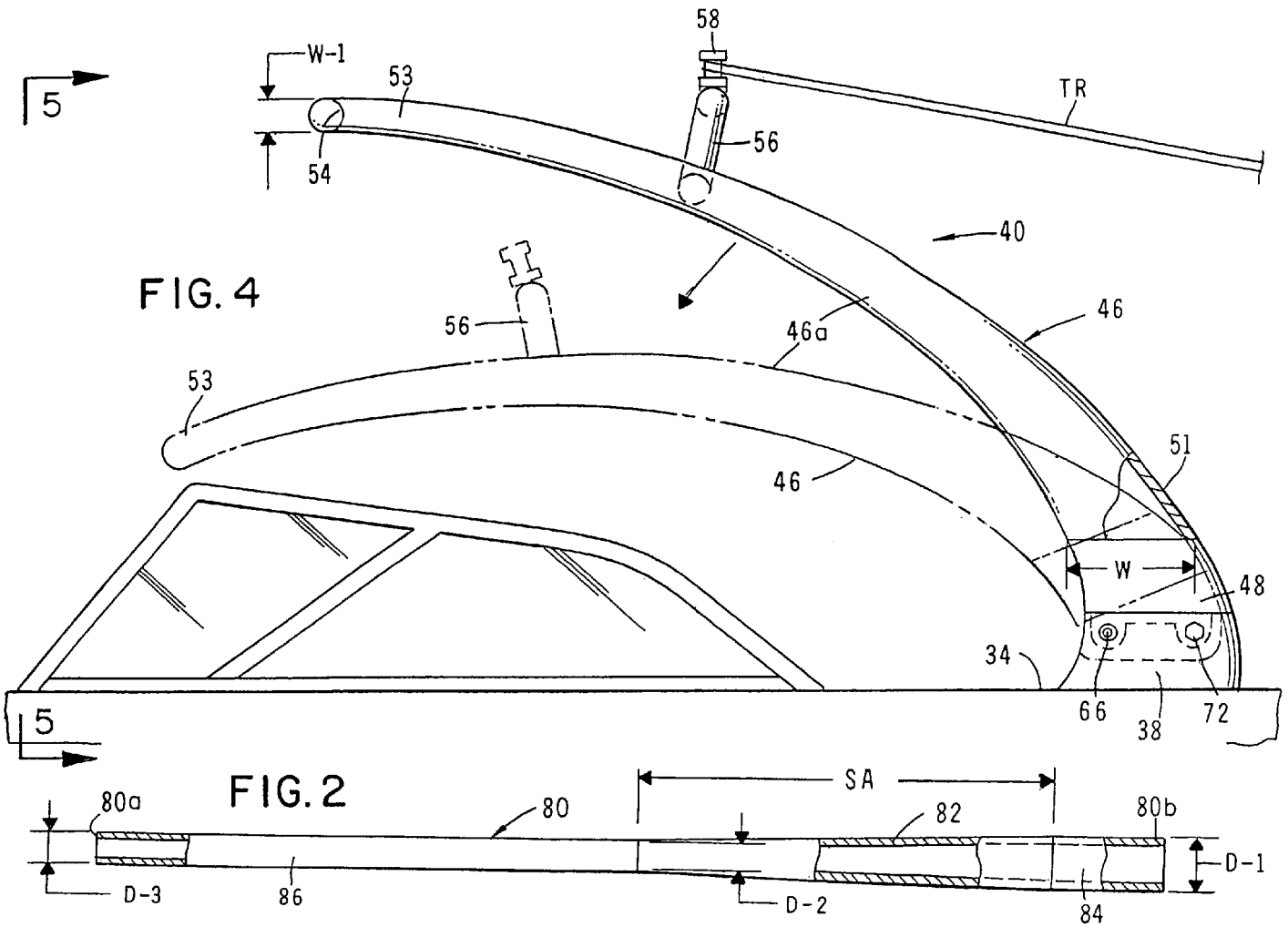
FIG. 2 is a top view, partly in cross section, illustrating one form of the method of the invention for making the wake tower.
FIG. 4 is a side-elevational view, partly broken away, to show internal construction, of the form of the wake tower shown in FIG. 1.
Figures 3, 5:
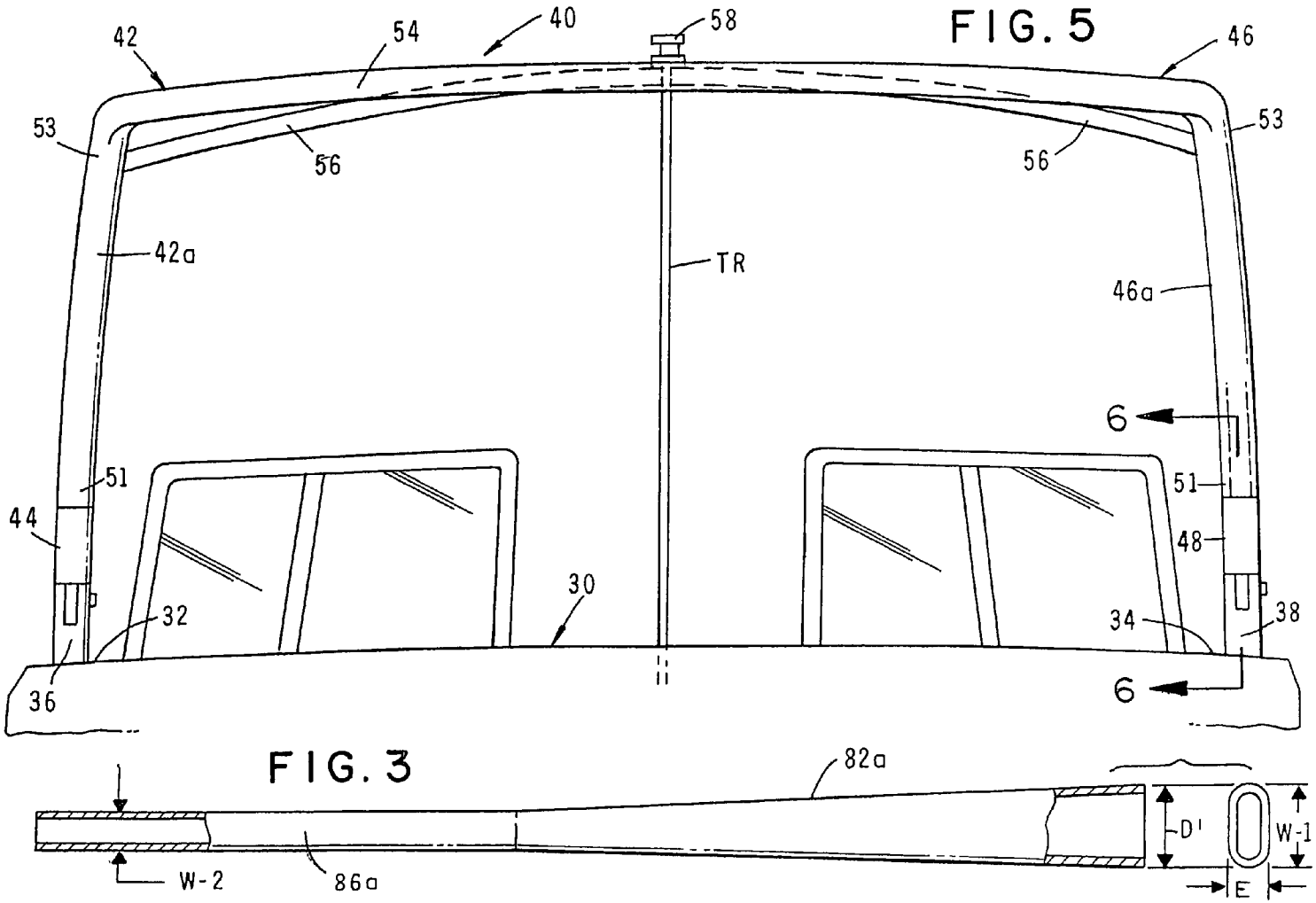
FIG. 3 is a side-elevational view, partly in cross section, further illustrating the method of the invention for making the wake tower.
FIG. 5 is a view taken along lines 5-5 of FIG. 4.

Referring to the drawings and particularly to FIGS. 1, 4 and 5, one form of the wake tower of the invention is shown interconnected with a powerboat 30 of conventional construction having a bow portion 30*a* and a stern portion 30*b*. As best seen in FIG. 5, the powerboat also has first and second spaced-apart gunwales 32 and 34 respectively to which the wake tower is connected. In the present form of the invention the wake tower includes an upwardly extending first base member 36 connected to the first gunwale 32 and an upwardly extending second base member 38 connected to said second gunwale 34. The base members 36 and 38 are of a curved configuration and are preferably cast from a lightweight metal such as aluminum.

Interconnected with the base members is a generally U-shaped, upwardly extending structural assembly generally designated by the numeral 40. The structural assembly 40 includes a generally "L"-shaped structural member 42 having a first curved side 42*a* and a cast aluminum first connector segment 44. Structural member 42 is connected to aluminum first connector segment 44 by any suitable means such as welding. In a manner presently to be described, connector segment 44 is, in turn, pivotally connected to first base member 36. Structural assembly 40 also includes a second generally "L"-shaped structural member 46 having a curved side 46*a* and a second, cast aluminum connector segment 48 that is connected to second curved side 46*a* by any suitable means such as welding. Connector segment 48 is, in turn, pivotally connected second base member 38.

As will be discussed in greater detail hereinafter, each of the sides of structural assembly 40 is first swaged into the desired configuration and then is strategically formed to create a curved, tapered portion having an oval shape. More particularly, as best seen in FIGS. 1 and 4, each of the sides of the structural assembly 40 includes a lower portion 51 having a first width W and an upper portion 53 having a second width W-1 that is substantially less than said first width W. Structural assembly 40 further includes a bight portion 54 interconnecting upper portions 53 of the sides. As indicated in FIG. 4, bight portion 54 is generally circular in cross section.

In the form of the invention shown in FIGS. 1 through 11, the wake tower further includes a tow rope connector member 56 that is connected to and spans upper portions 53 of the sides 42 and 46. Connected to the connector member 56 is a conventional type of connector 58 to which the tow rope "TR" can be connected.

Figures 6, 7, 8:
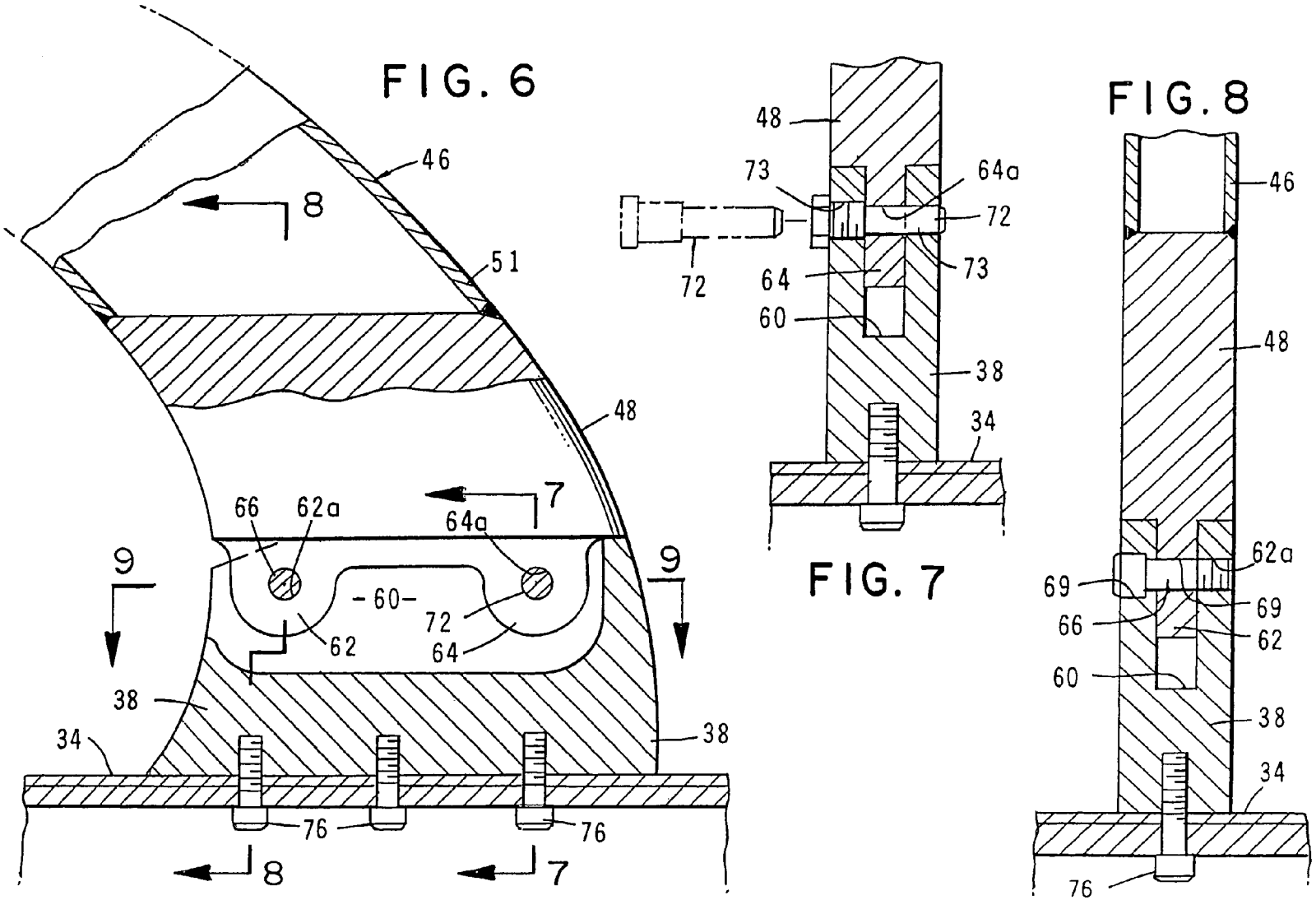
FIG. 6 is a greatly enlarged, cross-sectional view taken along lines 6-6 of FIG. 5.
FIG. 7 is an enlarged, cross-sectional view taken along lines 7-7 of FIG. 6.
FIG. 8 is in enlarged, cross-sectional view taken along lines 8-8 of FIG. 6.

Turning next to FIGS. 6, 7 and 8, a portion of one side of the wake tower of the invention is there shown. It is to be understood that the other side of the wake tower is of a similar construction, but is not shown in the drawings in order to simplify the description. Each of the base members is provided with a cavity 60 and each of the connector segments is provided with a pair of spaced-apart, downwardly extending ears 62 and 64 that are receivable within the base member cavities. As shown in FIG. 6, downwardly extending ear 62 has a bore 62*a* formed therein and, similarly, downwardly extending ear 64 has a bore 64*a* formed therein. Receivable within bore 62*a* is a pivot pin 66 about which side 46 and connector segment 48 can pivot in the manner shown in FIG. 11.

Figure 10:
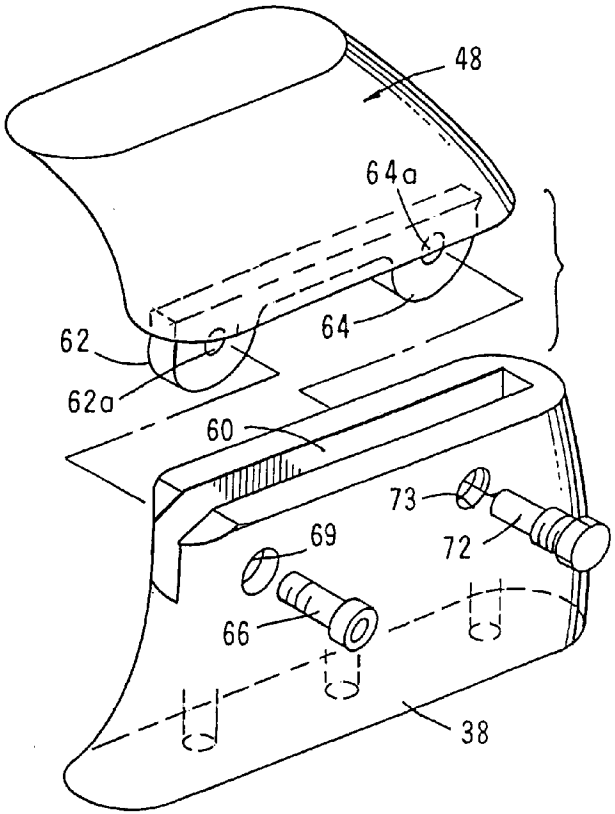
FIG. 10 is a generally perspective, exploded view of one of the base members and one of the connecting segments of the wake tower of the invention.
Figure 9:
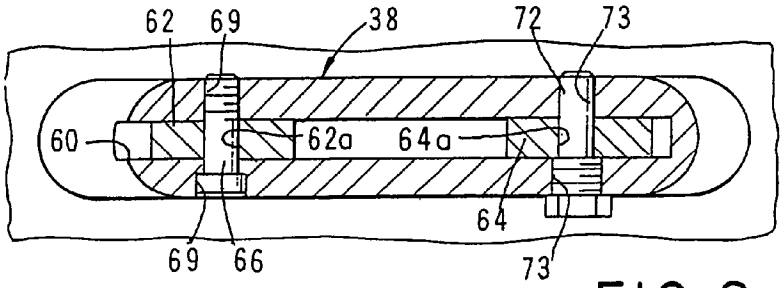
FIG. 9 is in enlarged, cross-sectional view taken along lines 9-9 of FIG. 6.
Figure 11:
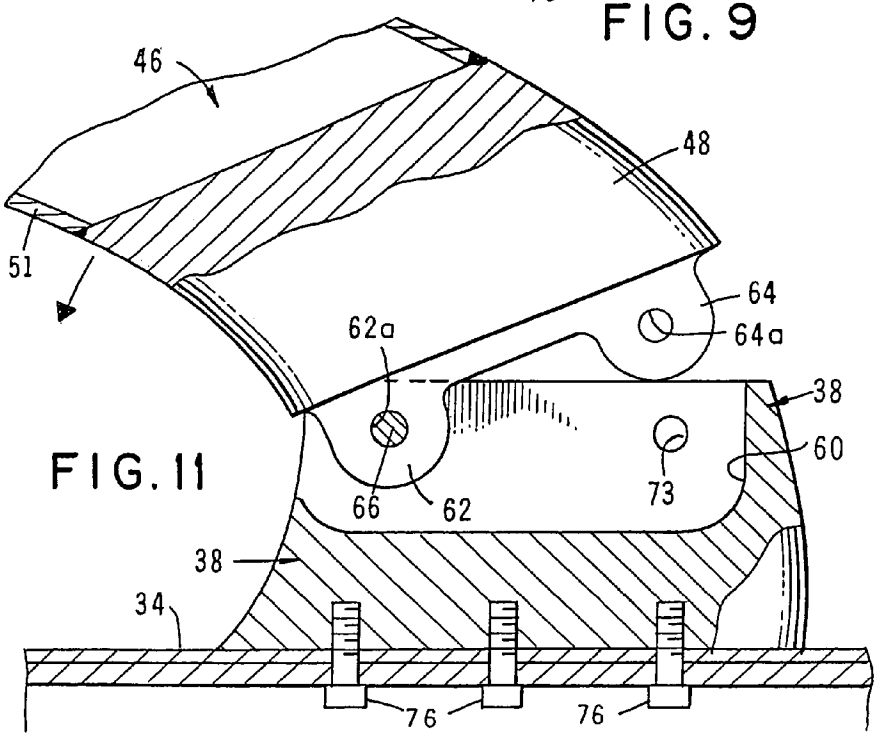
FIG. 11 is a fragmentary, cross-sectional view of the lower portion of one side of the wake tower of the invention illustrating the manner in which the wake tower pivots relative to the base member.

As illustrated in FIGS. 9 and 10, pivot pin 66 extends through aligned bores 69 formed in base member 38. Similarly, a locking pin 72 is receivable within bore 64*a* formed in ear 64. Locking pin 72 extends through aligned bores 73 formed in base member 38 and, when in position within these openings in the manner shown in FIGS. 6 in 9, prevents pivotal movement of side 46 and connector segment 48 about pivot pin 66. As indicated by the phantom lines in FIG. 7, when the locking pin 72 is removed from the base member, the combination of side 46 and connector segment 48 is free to pivot about pivot pin 66 in the manner shown in FIG. 11.

In accordance with one form of the method of making the wake tower illustrated in FIGS. 1 through 11, the first and second base members 36 and 38 are cast in a conventional manner from a suitable lightweight castable material such as aluminum and are appropriately finished. This done, the base members are interconnected with the powerboat by a plurality of threaded connectors 76 in the manner shown in FIG. 6.

The side members 42*a* and 46*a* are each formed individually by first heating a first length of tubing to an elevated, annealing temperature. This first length of tubing, which by way of example can be 6061-T6 aluminum tubing that has a diameter of approximately 5 inches, a first end 80*a* and a second end 80*b*. In the manner illustrated in FIG. 2, the heated length of tubing is swaged in a conventional manner well known to those skilled in the art to form a first swaged tube 80 having a tapered swaged portion 82 having a first end 84 of first diameter D-1 and a second end 86 of a second lesser diameter D-2 and a uniform diameter portion 86 having a diameter D-3 substantially equal to said second lesser diameter D-2.

Using an appropriate forming dye, the tapered swaged portion 82 of the swaged tube 82 is strategically formed to produce a tapered swaged portion 82*a* and an elongated uniform diameter portion 86*a* (FIG. 3). As illustrated in FIG. 3, swaged portion 82*a* is generally oval-shaped in cross section and has a thickness "E". Swaged portion 82*a* has a width W-1, while uniform diameter portion 86*a* has a lesser width W-2. This swaging step is done in a conventional manner using conventional tooling that is of the character well understood by those skilled in the art.

Following the swaging step, the swaged first tube 80 is strategically bent into the desired shape to form a first bent tube that is generally "L"-shaped in configuration and generally corresponds to the shape of member 42*a*.

Next, first connector segment 44 is cast in a conventional manner from a light weight castable material such aluminum and is connected by any suitable means such as welding to the bent tube formed by the swaging step to form a first wake tower subassembly 42, which generally corresponds to one-half of the structural assembly 40.

Following the forming of the first wake tower subassembly, a second length of aluminum tubing is swaged and formed in the identical manner described in the preceding paragraphs to produce a second side 46*a*. This done, second connector segment 48 is suitably cast from a light weight metal such as aluminum and is interconnected as by welding with second side 46*a* to form assembly 46 that generally corresponds to the second half of the structural assembly 40.

Next, the elongated, uniform diameter portions of the first and second wake tower subassemblies 42 and 46 are interconnected at their ends as by welding to form the structural member 40.

After completion of the construction of the structural member 40 in the manner described in the preceding paragraphs, the structural member is pivotally interconnected with the base members 36 and 38 in the manner depicted in FIGS. 6 through 10 of the drawings to form the construction shown in FIGS. 1 and 3. More particularly, the ears formed on each of the connector segments are inserted into the base cavities, the pivot pins 66 are inserted into bores 69 and 62*a* and the locking pins are inserted into bores 73 and 64*a*. With this construction, when it is desired to pivot the structural member into the forwardly stowed position in the manner illustrated in FIG. 11, locking pins 72 are removed from bores 73 and 64*a* to permit the structural member to pivot about pivot pin 66.

Turning next to FIGS. 12 through 27A, an alternate form of the wake tower unit of the invention is shown and generally designated by the numeral 101. This embodiment is similar in some respects to the embodiment shown in FIGS. 1 through 11 and like numerals are used in FIGS. 12 through 21 to identify like components. The main difference between this latest form of the invention and the earlier described form resides in the totally differently configured, unitary wake tower unit 101. More particularly, in the wake tower unit of this latest form of the invention comprises a windshield component and a tower assembly that are integrally formed as a single, unitary structure.

Figure 12:
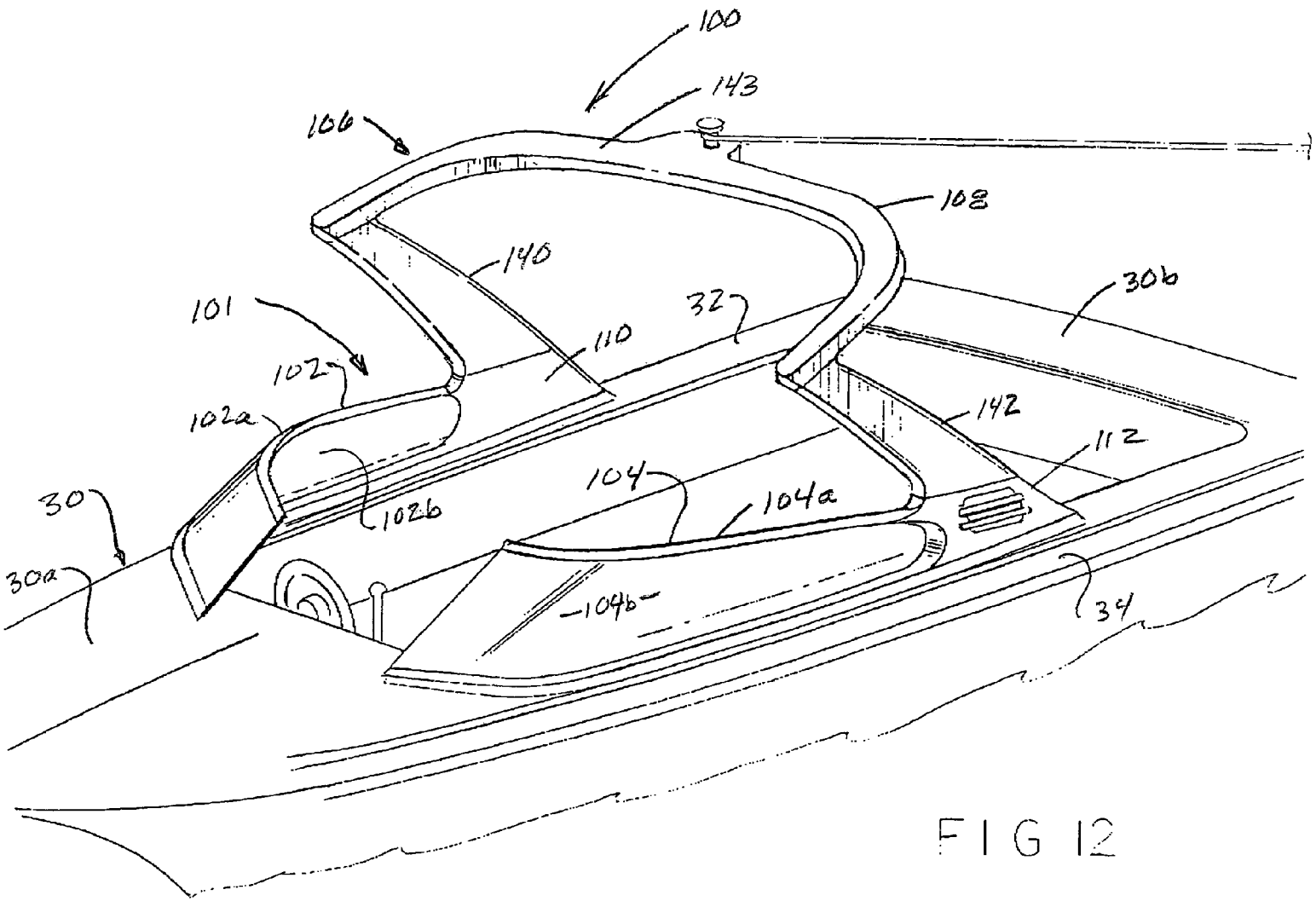
FIG. 12 is a generally perspective view of an alternate form of the tower of the present invention.

As before, and as illustrated in FIG. 12, wake tower apparatus 100 is specially designed to be interconnected with a powerboat 30 of conventional construction having a bow portion 30*a* and a stern portion 30*b* and first and second spaced-apart gunwales 32 and 34 respectively to which unit 100 is connected. In the present form of the invention the wake tower unit 101 comprises forwardly extending windshield portions 102 and 104 and a wake tower assembly generally designated by the numeral 106. Portion 102 comprises a curved frame 102*a* and a substantially transparent windshield 102*b* mounted within the curved frame. Similarly, portion 104 comprises a curved frame 104*a* and a substantially transparent windshield 104*b* mounted within the curved frame. As indicated in FIG. 12, assembly 106 is uniquely integrally formed with the windshield portions 102 and 104.

Figure 16:
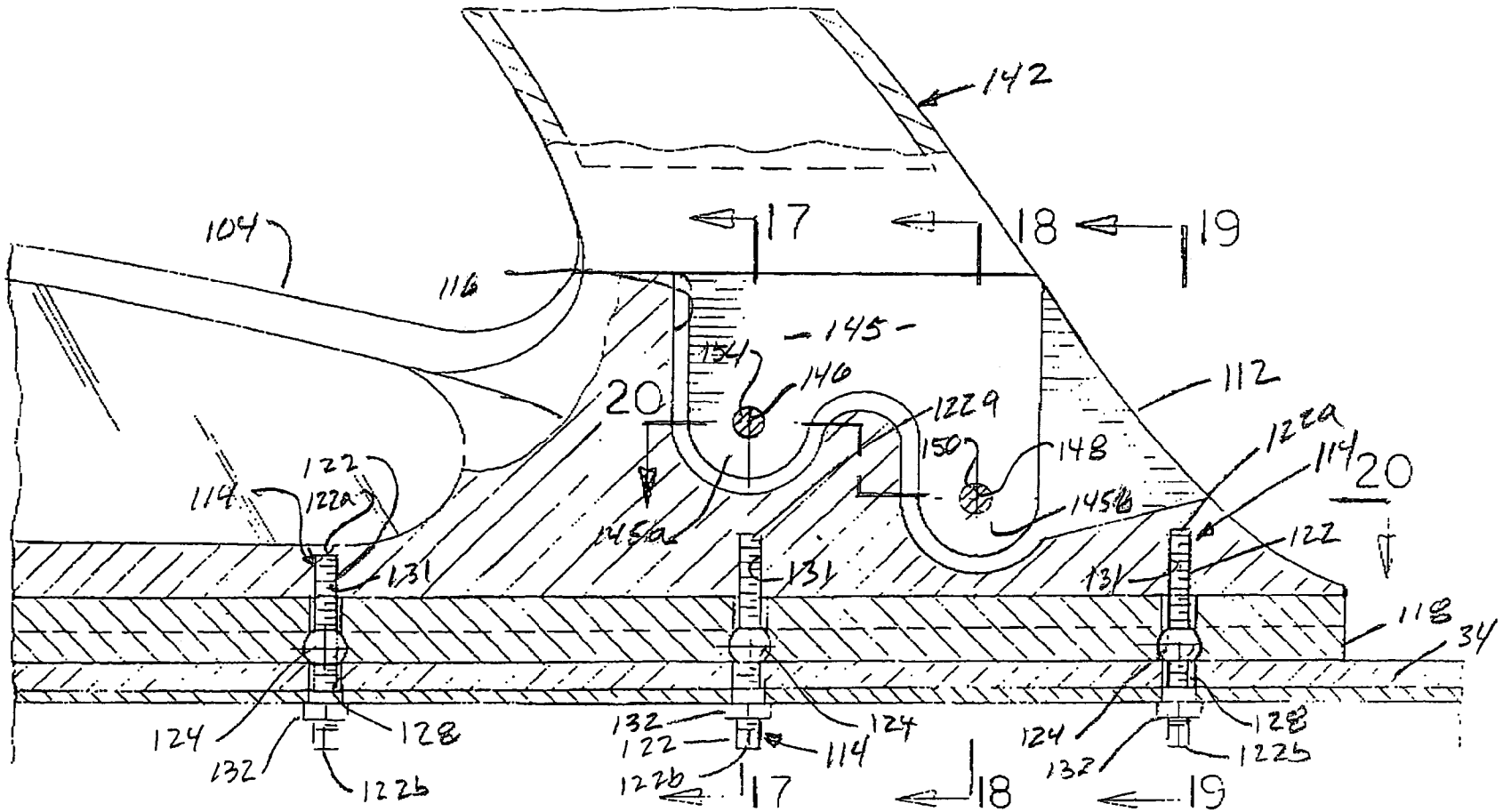
FIG. 16 is a fragmentary, cross-sectional view of the lower portion of the wake tower of the embodiment of FIG. 12 indicating the manner in which the wake tower can be pivoted from a first upright position shown in FIG. 1 to a second lowered position illustrated by the phantom lines in FIG. 13.
Figures 17, 18, 19:
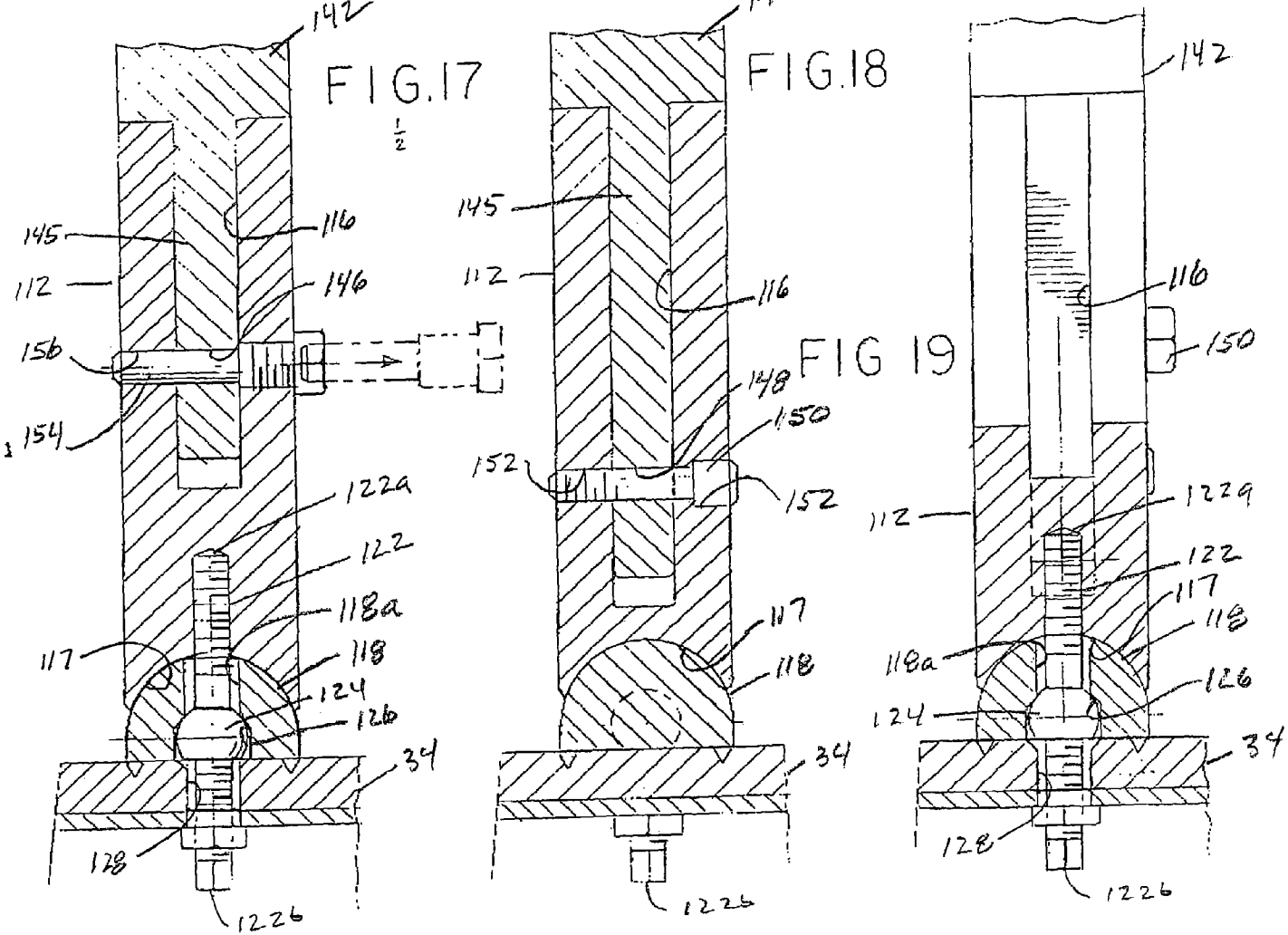
FIG. 17 is a greatly enlarged, cross-sectional view taken along lines 17-17 of FIG. 16.
FIG. 18 is a greatly enlarged, cross-sectional view taken along lines 18-18 of FIG. 16.
FIG. 19 is a greatly enlarged, cross-sectional view taken along lines 19-19 of FIG. 16.

Wake tower assembly 106 is somewhat similar in construction to the embodiment of FIGS. 1 through 12 and here comprises an upwardly extending first base connector 110 that is pivotally connected to the first gunwale 32 of the sports boat by means of a plurality of spaced-apart pivot connector assemblies 114 and an upwardly extending second base connector 112 that is pivotally connected to the second gunwale 34 of the sports boat by means of a plurality of substantially identically constructed pivot connector assemblies 114 (FIGS. 16 and 17). Pivotally connected to the first and second base connectors is a novel wake tower structure 108, the construction of which will presently be described. For reasons to be discussed in the paragraphs that follow, each of the base connectors is provided with an upper, generally vertical, slot-like cavity 116 and an elongated, lower cavity 117 that is generally semicircular in cross section (see FIGS. 16 and 17).

Affixed to each gunwale of the sports boat and forming a part of the apparatus of the invention is an elongated pivot support rail 118 that is generally semicircular in cross section. First and second base connectors 110 and 112, as well as part of the windshield portions of the wake tower unit, rest upon and are supported by support rails 118. As illustrated in FIGS. 16, 17, 19 and 25 rails 118 are closely received within the lower cavities 117 formed in the support members.

As best seen in FIGS. 16, 17 and 19, each of the pivot connector assemblies 114 comprises a threaded shaft 122 having first and second ends 122*a* and 122*b* and a generally spherical-shaped member 124 disposed intermediate ends 122*a* and 122*b*. Generally spherical-shaped members 124 are closely received within cavities 126 formed in rails 118. As indicated in FIG. 17, each of the rails 118 is also provided with spaced-apart bores 118*a* that have a diameter greater than the diameter of the upper portion of threaded shafts 122, which, as shown in FIGS. 17 and 19, extend through bores 118*a*.

The lower portion of each of the threaded shafts 122 extends through spaced-apart bores 128 formed in the gunwales 32 and 34, which bores have a diameter greater than the diameter of the lower portion of threaded shafts 122 (see FIG. 16). To secure the wake tower unit in position on the powerboat, the upper portion of each of the threaded shafts 122 is received within a threaded bore 131 formed in the base connectors 110 and 112 of the wake tower unit. Similarly, threaded nuts 132 are threadably connected proximate the lower ends of the threaded shafts 122 which extend through the gunwales, and are appropriately cinched down against the lower surface of the gunwales in the manner shown in FIG. 16. To better secure the threaded shafts in position within the enlarged diameter bores 128, semicircular-shaped shims 133 circumscribe the lower portions of the threaded shafts and are received within bores 128 in the manner best seen in FIGS. 25 and 26. With the construction thus described, the wake tower unit can be laterally adjusted in a manner depicted in FIGS. 24 and 25 as may be required to permit precise centering of the wake tower unit as the tower structure 108 is moved from the upraised position shown in the solid lines in FIG. 13 into the rearward, lowered position illustrated by the phantom lines in FIG. 13. More particularly, by holding the squared ends 122*b* of threaded members 122 with an appropriate wrench "W" (FIG. 26) the nuts 132 can be loosened and the position of the wake tower unit can be laterally adjusted from the position shown by the phantom lines in FIG. 24 to the position shown by the solid lines in FIG. 24. This lateral adjustment of the wake tower unit is possible because of the swivel-like interaction between the base connectors 110 and 112 and the support rails 118 and because of the clearance between the threaded members 122 and the enlarged diameter bores 118*a* and 128 formed in members 118 and in the gunwales respectively.

Referring once again to FIG. 12 of the drawings, it can be seen that the wake tower structure 108 comprises first and second side members 140 and 142 that are pivotally connected to first and second base connectors 110 and 112 respectively. Wake tower structure 108 also includes a generally U-shaped bight portion 143 that is connected to and spans first and second side members 140 and 142 in the manner best seen in FIGS. 12 and 14 of the drawings.

Figure 13:
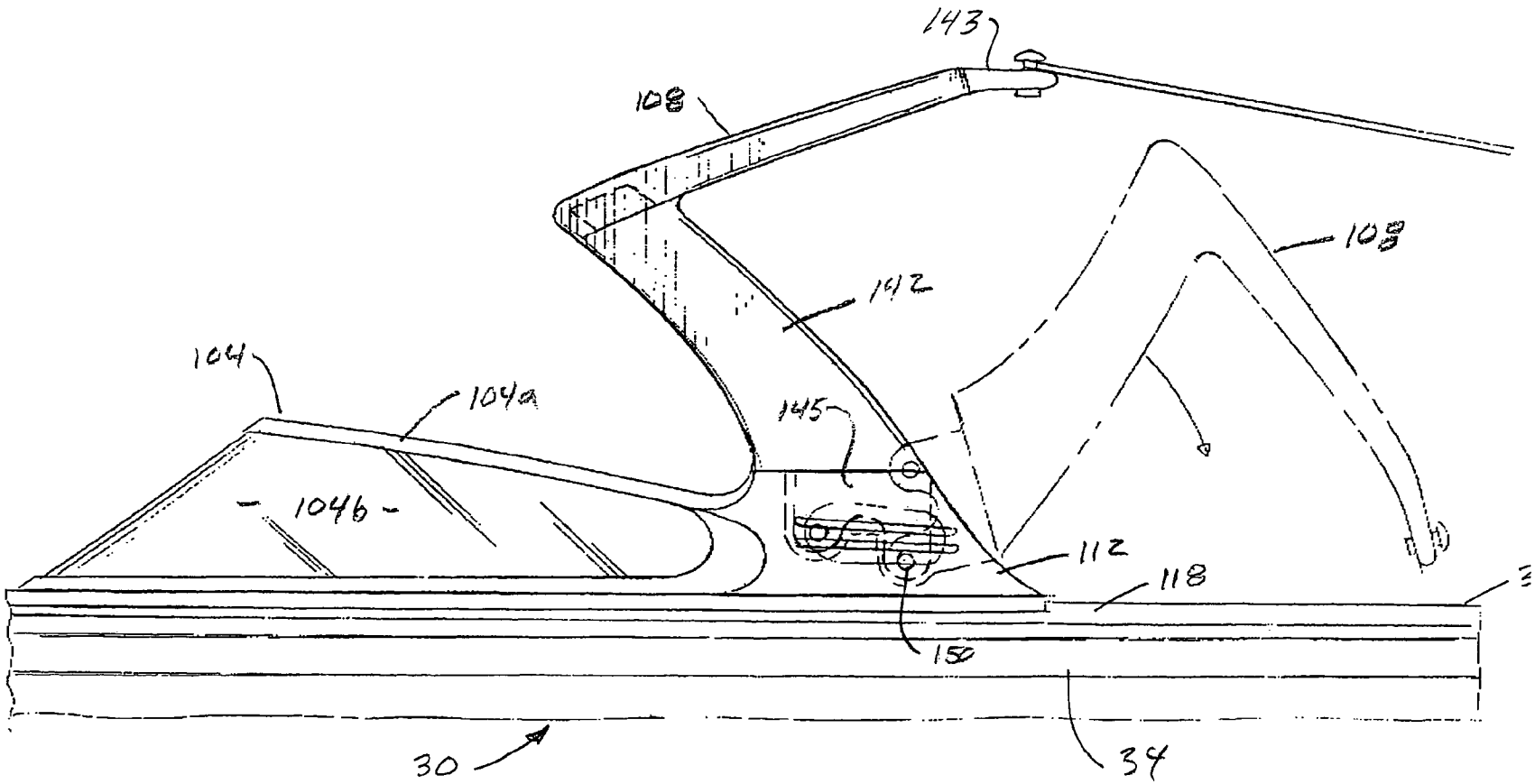
FIG. 13 is a side-elevational view of the wake tower shown in FIG. 12.
Figure 14:
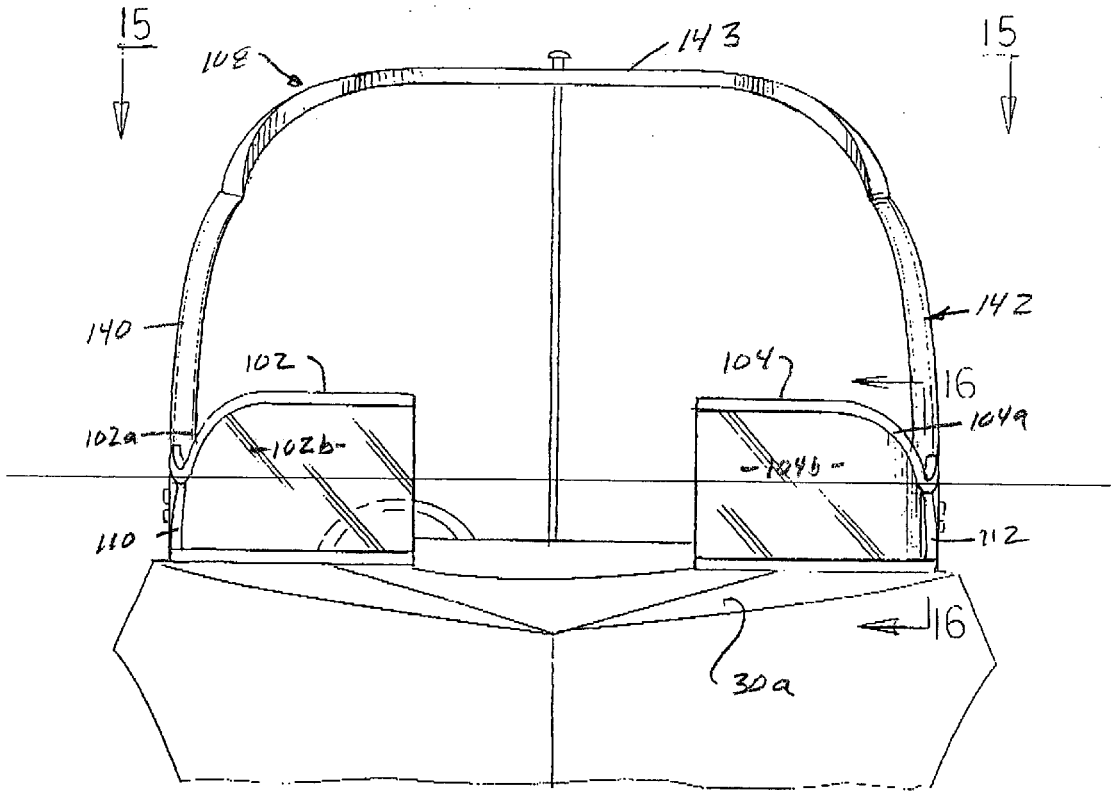
FIG. 14 is a front view of the wake tower shown in FIG. 12.
Figure 15:
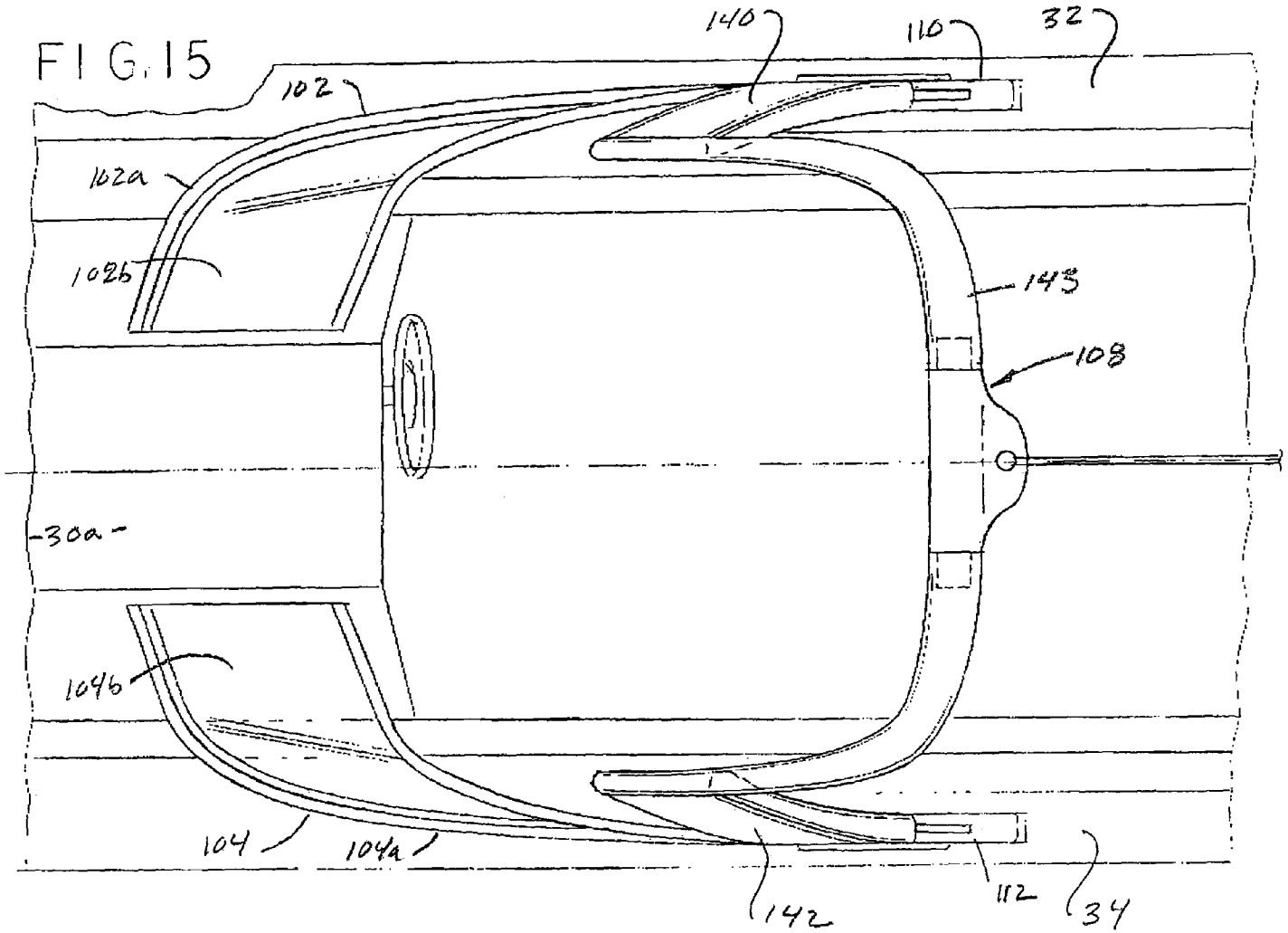
FIG. 15 is a top plan view of the wake tower shown in FIG. 12.

Each of the first and second side members 140 and 142 includes a connector segment 145 having a pair of spaced-apart, downwardly extending ears 145*a* and 145*b* that are receivable within the upper cavities 116 of the base members (see FIG. 13). Each connector segment is also provided with first and second spaced-apart bores 146 and 148. The connector segment of first side 140 is received within the upper cavity 116 formed in first base connector 110, while the connector segment of second side 142 is received within the upper cavity 116 formed in second base connector 112. Because of the similar manner in which the connector segments are connected to the first and second base connectors and to avoid duplication, only the manner of interconnection of the connector segment of the second side member 142 with the second base connector 112 will be described in the paragraphs that follow. Interconnection of the connector segment of the first side member 140 with the first base connector 110 is accomplished in a substantially identical manner and will not be described in detail. It is also to be understood that in FIG. 16, 17 through 22 and 21, only one side of the wake tower is shown. The other side of the wake tower, which is of a similar construction, is not shown in the drawings in order to avoid duplication.

Figure 20:
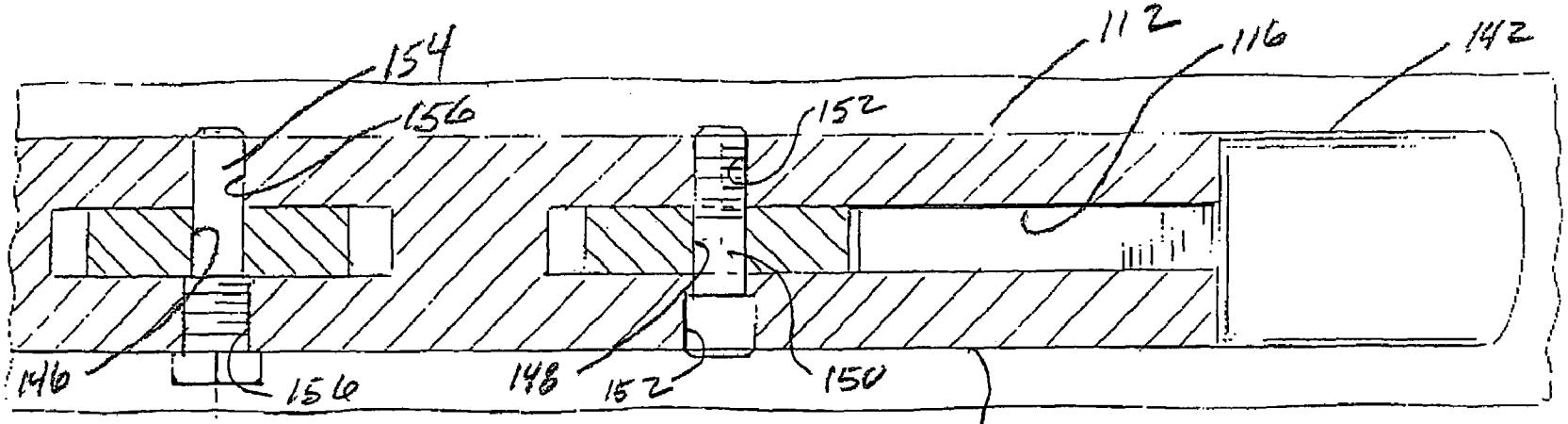
FIG. 20 is a cross-sectional view taken along lines 20-20 of FIG. 16.
Figure 22:
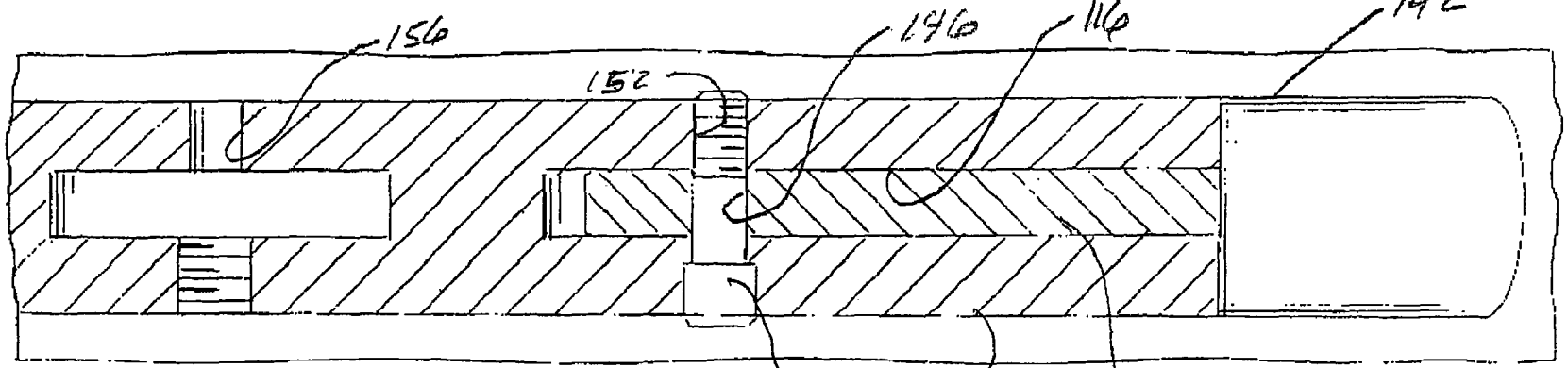
FIG. 22 is a greatly enlarged, cross-sectional view taken along lines 22-22 of FIG. 21.
Figures 21, 23:
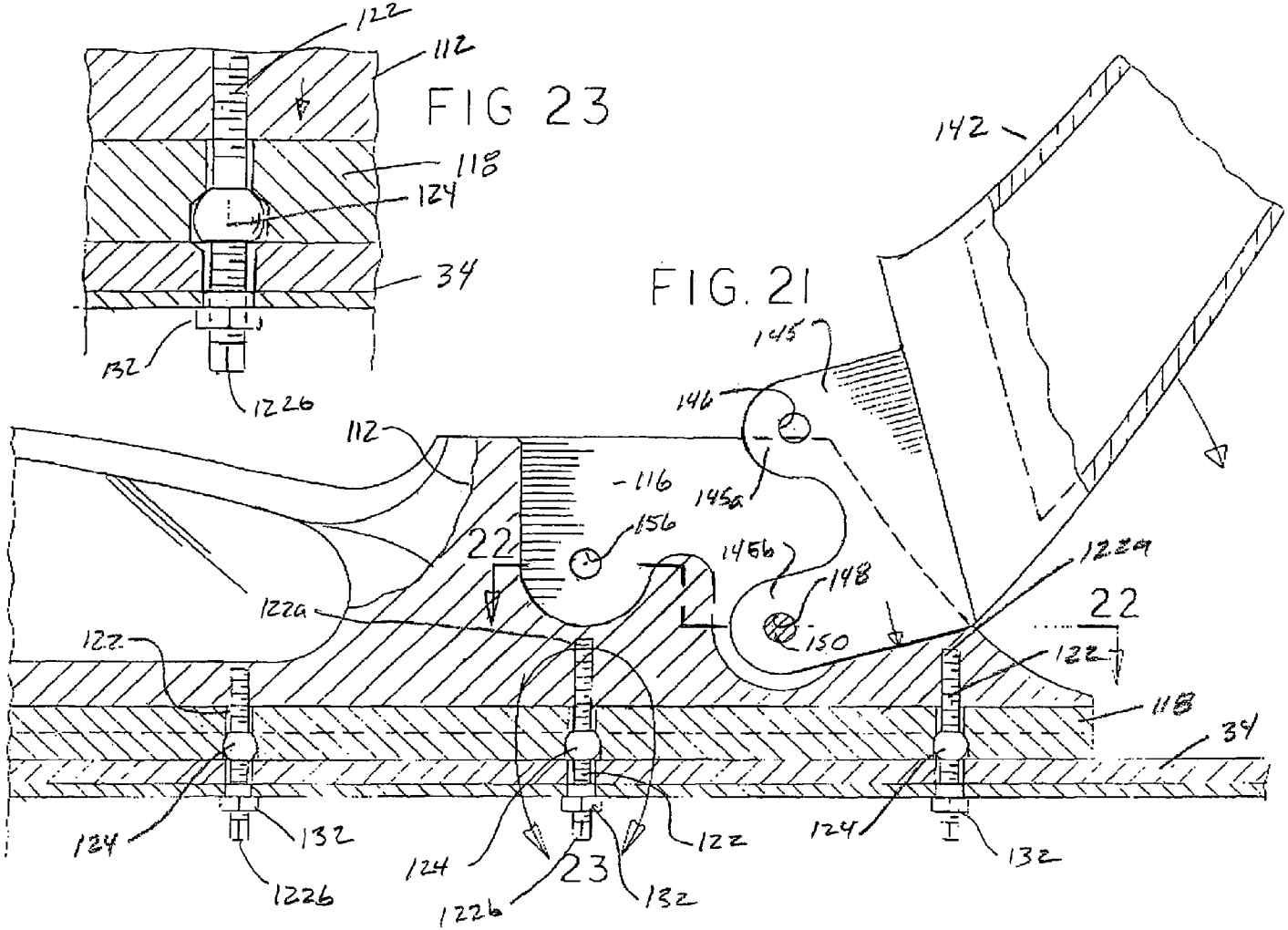
FIG. 21 is a cross-sectional view, similar to FIG. 16, but showing wake tower being pivoted toward its second position.
FIG. 23 is a greatly enlarged, cross-sectional view of the area designated in FIG. 21 as "23".
Figure 24:
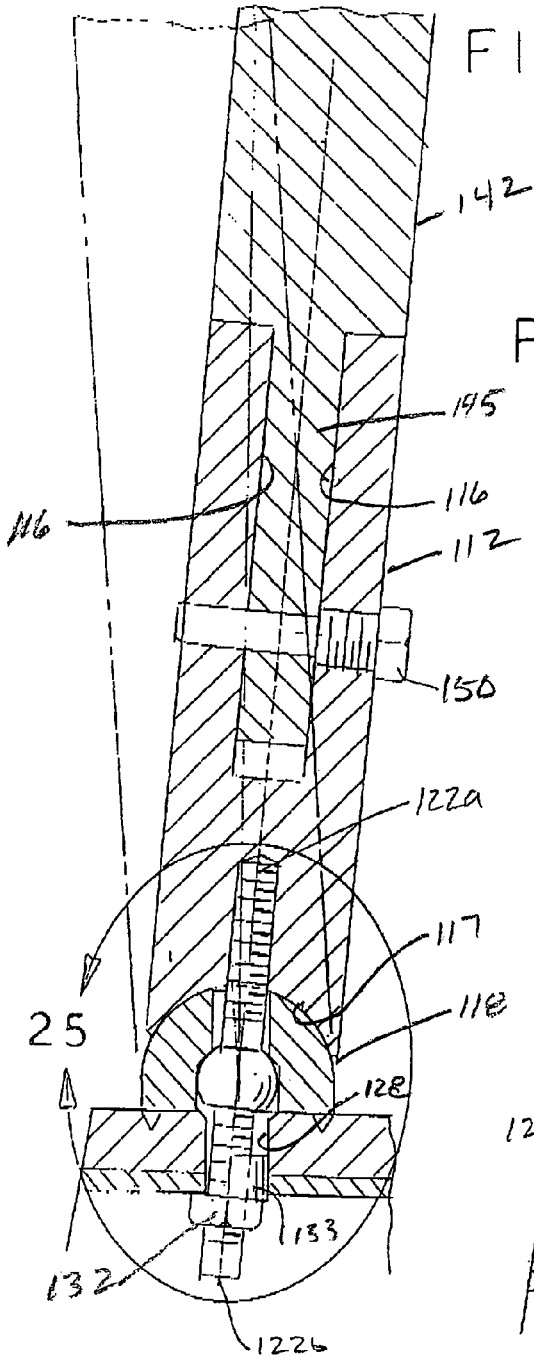
FIG. 24 is a greatly enlarged, fragmentary, cross-sectional view illustrating the manner by which one side of the wake tower can be pivoted relative to the gunwale.
Figure 26:
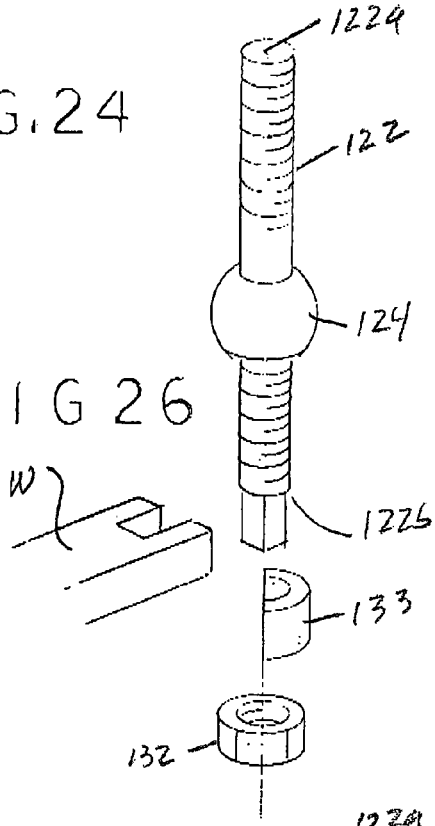
FIG. 26 is a generally perspective, exploded view illustrating one form of the connector means for interconnecting the wake tower to the gunwale.
Figure 25:
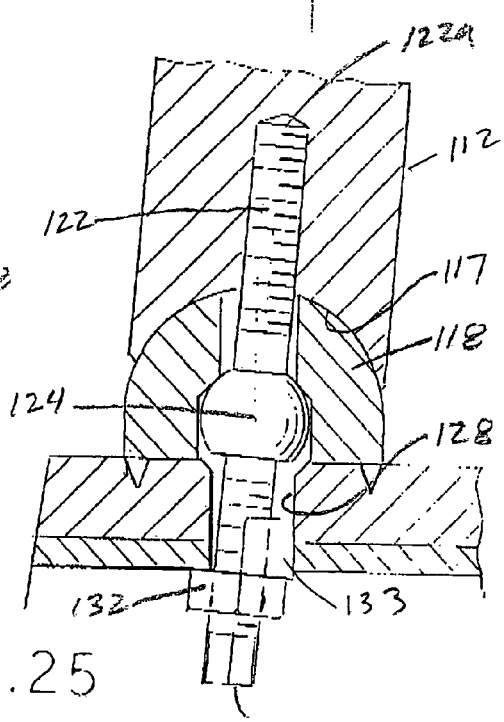
FIG. 25 is an enlarged, fragmentary view of the area designated in FIG. 24 as "25".

As illustrated in FIG. 20, a pivot pin 150 about which side member 142 can pivot in the manner shown in FIG. 21 is received within bore 148 and extends through aligned bores 152 formed in base member 112. Similarly, a locking pin 154 is receivable within bore 146 and extends through aligned bores 156 formed in base member 112 (FIG. 17). When the locking pin is in position within these openings in the manner shown in FIG. 20, pivotal movement of side member 142 and connector segment 145 about pivot pin 152 is prevented. As indicated by the phantom lines in FIG. 13 and the solid lines in FIG. 21, when the locking pin 146 is removed from the base member, the combination of side member 142 and connector segment 145 is free to pivot about pivot pin 152.

Figures 27, 27A:
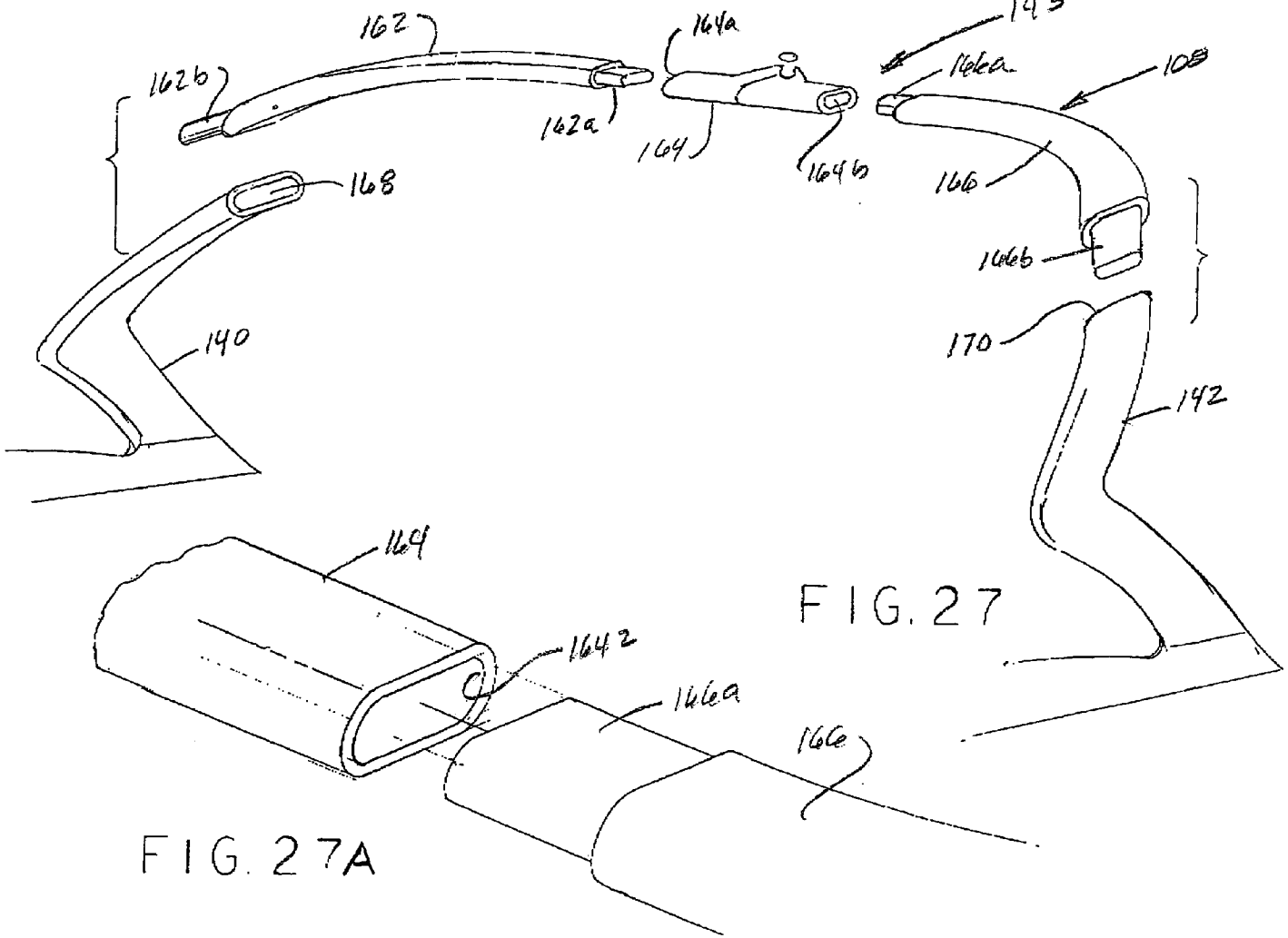
FIG. 27 is a generally perspective, exploded view illustrating the manner by which the various segments that make up the wake tower are interconnected.
FIG. 27A is an enlarged, generally perspective view of one of the interconnection segments shown in FIG. 27.

Turning to FIGS. 27 and 27A, for ease of manufacture, the tower structure 108 of this latest form of the apparatus uniquely comprises a plurality of interconnected bight segments 162, 164 and 166. Bight segment 164 is hollow and is provided at its extremities with tongue receiving openings 164*a* and 164*b*. Opening 164*a* closely receives a tongue 162*a* provided proximate one end of bight segment 162, while opening 164*b* closely receives a tongue 166*a* provided proximate one end of bight segment 166 (FIG. 27A). In similar fashion, side 140 is provided at its upper extremity with a tongue receiving opening 168 which closely receives a tongue 162*b* provided proximate the other end of bight segment 162. Similarly, side 142 is provided at its upper extremity with a tongue receiving opening 170 which closely receives a tongue 166*b* provided proximate the other end of bight segment 166. Following the assembly of the tower 108, the various tongues can be secured in place within their mating components by welding, adhesive bonding, or the like.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. In combination, a sports boat having first and second spaced-apart gunwales, a bow portion and a stern portion, an integrally formed windshield-wake tower unit, said unit comprising:

(a) a forwardly extending windshield portion comprising a curved frame and a substantially transparent windshield mounted within said curved frame; and (b) a wake tower assembly integrally formed with said windshield portion, said wake tower assembly comprising:

(i) an upwardly extending first base connector connected to the first gunwale of the sports boat, said first base connector having a cavity;

(ii) an upwardly extending second base connector connected to said second gunwale of the sports boat, said second base connector having a cavity; and (iii) an upwardly extending tower structure connected to upwardly extending first and second base connectors, said tower structure comprising:

a. a first side, including a connector segment pivotally connected to said first base connector, said connector segment having first and second spaced-apart bores and being received within said cavity of said first base connector;

b. a second side, including a connector segment pivotally connected to said second base connector, said connector portion having first and second spaced-apart bores and being received within said cavity of said second base connector; and c. a generally U-shaped bight portion connected to and spanning said first and second sides.

2. The combination as defined in claim 1 in which said first base connector includes a cavity for closely receiving said connector segment of said first side and in which said second base connector includes a cavity for closely receiving said connector segment of said second side.

3. The combination as defined in claim 2 in which each of said connector segments of said first and second sides includes first and second spaced-apart bores.

4. The combination as defined in claim 3 further including a pivot pin received within said first spaced-apart bores of each of said connector segments and a locking bolt received within said second spaced-apart bores of each of said connector segments.

5. The combination as defined in claim 4 in which said upwardly extending tower structure is pivotally movable in a direction toward the stern portion of the sports boat.

6. The combination as defined in claim 5 in which said generally U-shaped bight portion comprises a plurality of interconnected bight segments.

7. The combination as defined in claim 6 in which at least one of said plurality of interconnected bight segments is hollow and in which another of said plurality of interconnected bight segments includes a tongue portion telescopically receivable within said hollow segment.

8. In combination, a sports boat having first and second spaced-apart gunwales, a bow portion and a stern portion, a wake tower assembly comprising:

(a) a forwardly extending windshield portion comprising a curved frame and a substantially transparent windshield mounted within said curved frame; and (b) a wake tower assembly integrally formed with said windshield portion, said wake tower assembly comprising:

(i) an upwardly extending first base connector connected to the first gunwale of the sports boat, said first base connector having an upper cavity and a lower cavity;

(ii) an upwardly extending second base connector connected to said second gunwale of the sports boat, said second base connector having an upper cavity and a lower cavity;

(iii) an upwardly extending tower structure connected to said first and second base connectors, said tower structure comprising a first side, including a connector segment received within said upper cavity of and being pivotally connected to said first base connector; a second side, including a connector segment received within said upper cavity of and being pivotally connected to said second base connector; and a generally U-shaped bight portion connected to and spanning said first and second sides.

9. The combination as defined in claim 8 in which said apparatus further includes a first pivot support track connected to said first gunwale, said first pivot support track being received within said lower cavity of said first base connector and a second pivot support track connected to said second gunwale, said second pivot support track being received within said lower cavity of said second base connector.

10. The combination as defined in claim 9 in which each of said first and second pivot support tracks are generally semicircular in cross section.

11. The combination as defined in claim 10 in which said upwardly extending tower structure is pivotally movable in a direction toward the stern portion of the sports boat.

12. The combination as defined in claim 10 in which said generally U-shaped bight portion of said tower structure comprises a plurality of interconnected segments.

13. In combination, a sports boat having first and second spaced-apart gunwales, a bow portion and a stern portion, a water sport apparatus, including a unitary structure comprising a windshield portion and a wake tower assembly, said unitary structure being connected to the first and second gunwales of the sports boat, said wake tower assembly further comprising a first base connector connected to said first gunwale of said sports boat, a second base connector connected to said second gunwale of said sports boat and a tower structure pivotally connected to said first and second base connectors.

14. The combination as defined in claim 13 in which said tower structure comprises upwardly extending first and second sides and a bight portion connected to and spanning said first and second sides.

15. The combination as defined in claim 14 in which said unitary structure is movable laterally relative to said first and second gunwales of said sports boat.

16. The combination as defined in claim 15 in which each of said first and second base connectors has upper and lower cavities and in which each of said first and second sides has a downwardly extending connector segment.

17. The combination as defined in claim 16 in which each of said connector segments of said first and second side members includes first and second spaced-apart bores.

18. The combination as defined in claim 17, further including a pivot pin received within said first spaced-apart bores of each of said connector segments and a locking bolt received within said second spaced-apart bores of each of said connector segments.

19. The combination as defined in claim 18 in which said bight portion of said wake tower structure comprises a plurality of interconnected bight segments.

* * * * *